US005605533A

United States Patent [19]

Badilla

[11] Patent Number: 5,605,533

[45] Date of Patent: Feb. 25, 1997

[54] TOUCH ACTIVATED FOOT MASSAGE DEVICE

[76] Inventor: Bernard D. Badilla, 551 Peralta Ave., San Francisco, Calif. 94110

[21] Appl. No.: 531,320

[22] Filed: Sep. 20, 1995

[51] Int. Cl.[6] ..... A61H 7/00

[52] U.S. Cl. ..... 601/103; 601/104

[58] Field of Search ..... 601/97–101, 103, 601/84, 94, 95, 104, 128, 107, 111, 110, 27–29

[56] References Cited

U.S. PATENT DOCUMENTS

| | | | |
|---|---|---|---|
| 2,186,105 | 1/1940 | Hall | 601/111 |
| 2,413,133 | 12/1946 | Aydelotte | 607/97 X |
| 2,958,227 | 11/1960 | Peterson | 601/103 X |
| 3,626,933 | 12/1971 | Pollock | 601/104 |
| 4,085,738 | 4/1978 | Kodera | 601/104 |
| 4,469,093 | 9/1984 | Chaplar | 601/97 X |
| 4,513,736 | 4/1985 | Thurber | 601/15 X |
| 4,679,549 | 7/1987 | Quam et al. | 601/128 |
| 4,856,496 | 8/1989 | Chursinoff | 601/104 |

FOREIGN PATENT DOCUMENTS

| | | | |
|---|---|---|---|
| 4332104 | 3/1994 | Germany | 601/101 |
| 1623651 | 1/1991 | U.S.S.R. | 601/104 |
| 2157949 | 11/1985 | United Kingdom | 601/94 |

*Primary Examiner*—Robert A. Hafer
*Assistant Examiner*—Brian E. Hanlon

[57] ABSTRACT

A touch activated foot massage device including a housing that has a front portion, back end and side walls. The housing has a top with a plurality of ball chambers and a bottom. Included is a U-shaped cover with an upper portion that has a pair of sleeves that are in communication with the side walls of the housing. A plurality of balls are provided. Each ball has a rigid interior with a crank pin within. Included is a plurality of crank shafts. Each crank shaft has a coupling end, a rotation end and a crank. The crank extends into each rubber ball and is in communication with the crank pin of the ball. Each crank shaft is supported within the housing by a pair of projections. Lastly, a motor is positioned within the front portion of the housing. The motor has a shaft rod with a gear. The gear has a tooth belt that extends around the pulley of each crank shaft.

1 Claim, 3 Drawing Sheets

10
12
14
32
3
36
22
24
16
38
26
20
3

18
34
14
16
24

TOUCH ACTIVATED FOOT MASSAGE DEVICE

BACKGROUND OF THE INVENTION

1. Field of the Invention

The present invention relates to a touch activated foot massage device and more particularly pertains to allowing a person to place their foot therein for a foot massage and further allowing the foot that is positioned within the touch activated foot massage device to activate the motor to cause the massaging action.

2. Description of the Prior Art

The use of massage devices is known in the prior art. More specifically, massage devices heretofore devised and utilized for the purpose of massaging the foot are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,158,073 to Bukowski discloses an acupressure foot massage mat. U.S. Pat. No. Des. 329,499 to Ohashi discloses a electric foot massager. U.S. Pat. No. 4,807,602 to Scarborough et al. discloses a foot massager. U.S. Pat. No. 4,802,463 to Rojas discloses a foot massager. U.S. Pat. No. Des. 281,735 to Seltzer discloses a foot massaging sandal. Lastly, U.S. Pat. No. Des. 280,934 to MacGregor discloses a foot massager.

While these devices fulfill their respective, particular objectives and requirements, the aforementioned patents do not describe touch activated foot massage device that is touch activated and uses a crank in communication with rubbers balls to provide the massaging action on the bottom of the foot.

In this respect, the Touch activated foot massage device according to the present invention substantially departs from the conventional concepts and designs of the prior art, and in doing so provides an apparatus primarily developed for the purpose of allowing a person to place their foot therein for a foot massage and further allowing the foot that is positioned within the touch activated foot massage device to activate the motor to cause the massaging action.

Therefore, it can be appreciated that there exists a continuing need for a new and improved Touch activated foot massage device which can be used for allowing a person to place their foot therein for a foot massage and further allowing the foot that is positioned within the touch activated foot massage device to activate the motor to cause the massaging action. In this regard, the present invention substantially fulfills this need.

SUMMARY OF THE INVENTION

In view of the foregoing disadvantages inherent in the known types of massage devices now present in the prior art, the present invention provides an improved touch activated foot massage device. As such, the general purpose of the present invention, which will be described subsequently in greater detail, is to provide a new and improved touch activated foot massage device and method which has all the advantages of the prior art and none of the disadvantages.

To attain this, the present invention essentially comprises a generally rectangular housing. The housing has a front portion, back end and side walls therebetween. The housing has a top with a plurality of ball chambers therethrough and a bottom. Each ball chamber has a diameter of about ½ inch. The housing has an exterior width of about 5 to 6 inches. The housing having a height of about 4 inches and the front portion has a front height about 30 percent greater. The housing has a length between about 14 to 15 inches. Included is a generally U-shaped cover. The cover is formed of a flexible material and has an upper portion with a pair of sleeves extending therefrom. The cover is positioned over the housing with the sleeves in communication with the side walls of the housing. The cover has a decreasing height along the length of the housing with the height being 75 percent less at the front portion. Also, a plurality of rubber balls are provided. Each ball has a rigid interior with a crank pin therein. Each rubber ball has a diameter for allowing each ball to pass through a respective ball chamber of the top of the housing. A plurality of crank shafts are included, Each crank shaft has a coupling end, a rotation end and a plurality of cranks therebetween. Each crank shaft is positioned within the housing and has one of each cranks extending into each rubber ball and in communication with the crank pin of each ball. The crank is integral the crank pin. The coupling end of each crank shaft has a pulley coupled therearound. The crank shaft has a length of about 4 to 5 inches and is supported within the housing by a pair of rectangular projections. Each projection is within the housing and extends upward from the bottom, and spaced from the side wall of the housing. Each projection has an upper end with a bearing therein. One of each bearing is capable of receiving the coupling end prior to the coupling end having been positioned within the pulley. The other bearing is capable of receiving the rotation end of each crank shaft. Additionally, a cylindrical motor is provided. The motor is positioned within the front portion of the housing. The motor has a shaft rod with a gear extending therefrom. The gear is integral with the shaft rod and has a tooth belt positioned therearound. The tooth belt is capable of rotating about the gear when the motor is operable. Lastly, the tooth belt has a length to extend around the pulley of each crank shaft. The length of the belt is about 75 percent of the length of the housing. The tooth belt is capable of applying tension when wrapped around the pulley of the crank shaft to allow movement of the crank. The crank shaft is moved along a center of rotation when the motor being activated. The motor being activated when a foot being positioned on the top of the housing applies a force to the balls thus causing the crank to move the crank shaft. Moving the crank shaft will cause the belt around the gear to move.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved touch activated foot massage device which has all of the advantages of the prior art massage devices and none of the disadvantages.

It is another object of the present invention to provide a new and improved touch activated foot massage device which may be easily and efficiently manufactured and marketed.

It is further object of the present invention to provide a new and improved touch activated foot massage device which is of durable and reliable constructions.

An even further object of the present invention is to provide a new and improved touch activated foot massage device which is susceptible of a low cost of manufacture with regard to both materials and labor, and which accordingly is then susceptible of low prices of sale to the consuming public, thereby making such touch activated foot massage device economically available to the buying public.

Still yet another object of the present invention is to provide a new and improved touch activated foot massage device which provides in the apparatuses and methods of the prior art some of the advantages thereof, while simultaneously overcoming some of the disadvantages normally associated therewith.

Even still another object of the present invention is to provide a touch activated foot massage device for allowing a person to place their foot therein for a foot massage and further allowing the foot that is positioned within the touch activated foot massage device to activate the motor to cause the massaging action.

Lastly, it is an object of the present invention to provide a new and improved touch activated foot massage device that includes a housing. The housing has a front portion, back end and side walls therebetween. The housing has a top with a plurality of ball chambers therethrough and a bottom. Included is a U-shaped cover. The cover has an upper portion with a pair of sleeves extending therefrom. The cover is positioned over the housing with the sleeves in communication with the side walls of the housing. Also provided is a plurality of balls. Each ball has a rigid interior with a crank pin therein. Included is a plurality of crank shafts. Each crank shaft has a coupling end, a rotation end and a crank therebetween. Each crank shaft has the crank extending into each rubber ball and in communication with the crank pin of each ball. The crank shaft is supported within the housing by a pair of rectangular projections. Lastly, a motor is positioned within the front portion of the housing. The motor has a shaft rod extending therefrom. The shaft rod has a gear with and a tooth belt positioned therearound. The tooth belt extends around the pulley of each crank shaft when positioned around the gear. The tooth belt is rotated about the gear when the motor is operable and applies tension to the pulley for allowing movement of the crank and balls.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
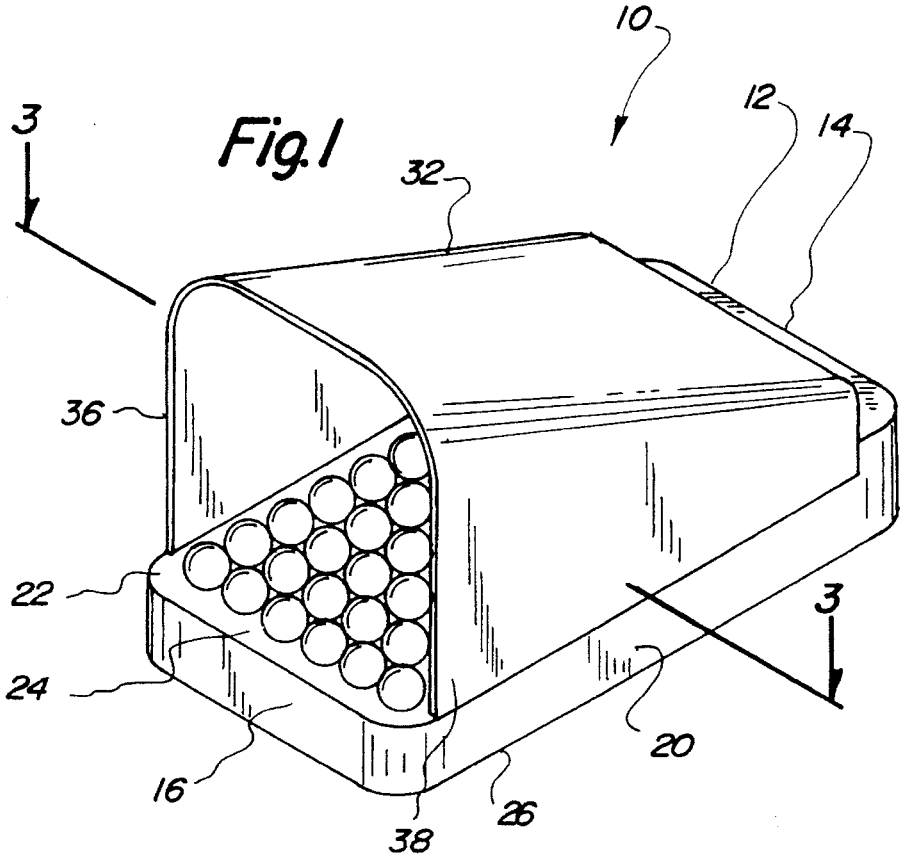
FIG. 1 is a perspective view of the preferred embodiment of the touch activated foot massage device constructed in accordance with the principles of the present invention.

With reference now to the drawings, and in particular to FIG. 1 thereof, the preferred embodiment of the new and improved touch activated foot massage device embodying the principles and concepts of the present invention and generally designated by the reference numeral 10 will be described.

The present invention, the touch activated foot massage device 10 is comprised of a plurality of components. Such components in their broadest context include a housing, a cover, balls, a crank shaft and a motor. Such components are individually configured and correlated with respect to each other so as to attain the desired objective.

Specifically, the present invention includes a generally rectangular housing 12. The housing is formed of a rigid plastic. The housing, as shown in FIG. 1, has a front portion 14, back end 16 and side walls 18 and 20 therebetween. The housing has a top 22 with a plurality of ball chambers 24 therethrough and a bottom 26. The bottom of the housing may be fitted with slid resistant rubber patches. Each ball chamber has a diameter of about ½ inch. The housing has an exterior width of about 5 to 6 inches. The back end and side walls have a height of about 4 inches and the front portion has a front height about 30 percent greater than the back end and side walls. The greater height of the front portion provides space for the motor. The housing has a length between about 14 to 15 inches. This length will accommodate a variety of feet.

Figure 2:
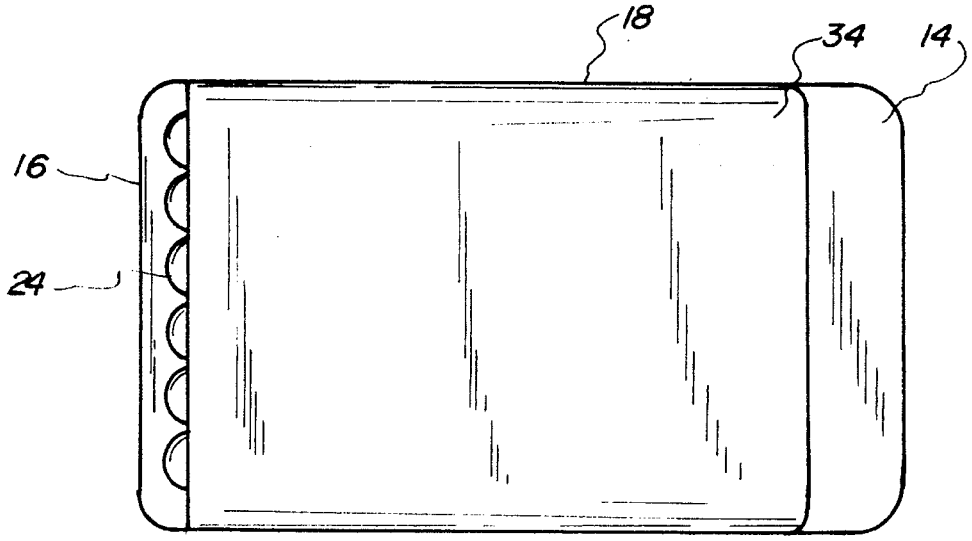
FIG. 2 is a top plan view of the preferred embodiment of the present invention
Figure 3:
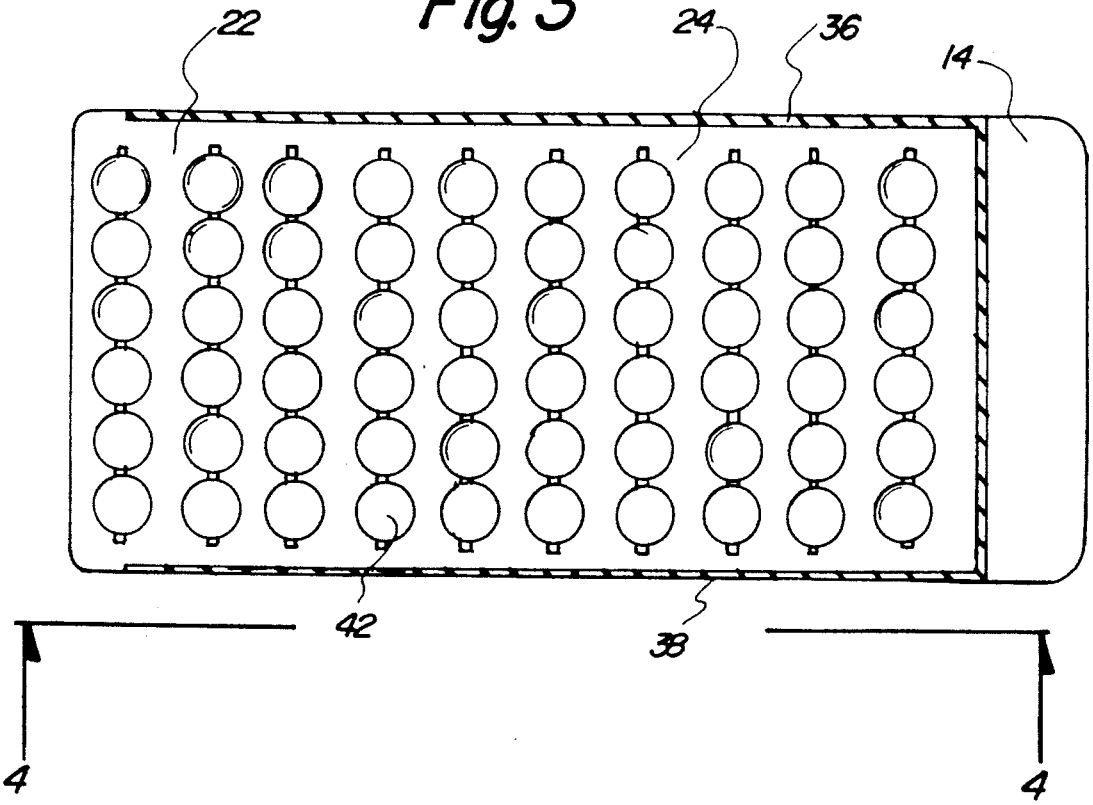
FIG. 3 is top view of the present invention along line 3—3 FIG. 1 and showing the cover removed.

As best illustrated in FIG. 1 a generally U-shaped cover 32 is provided. The cover, as shown in FIG. 2, is formed of a flexible material having an upper portion 34 with a pair of sleeves 36 and 38 extending therefrom. The cover is positionable over the housing with the sleeves in communication with the side walls 18 and 20 of the housing 12. The cover has a height of 3½ to 4 inches extending from the back end of the housing. The cover having a decreasing height along the length of the housing with the height being 75 percent less at the front portion than at the back end of the housing 16. The height of the cover at the back end of the housing will allow the foot to easily be positioned on the device. The cover allows the heat generated as the foot is massaged to remain around the foot. The heat adds to the therapeutic benefits of the device.

Figure 4:
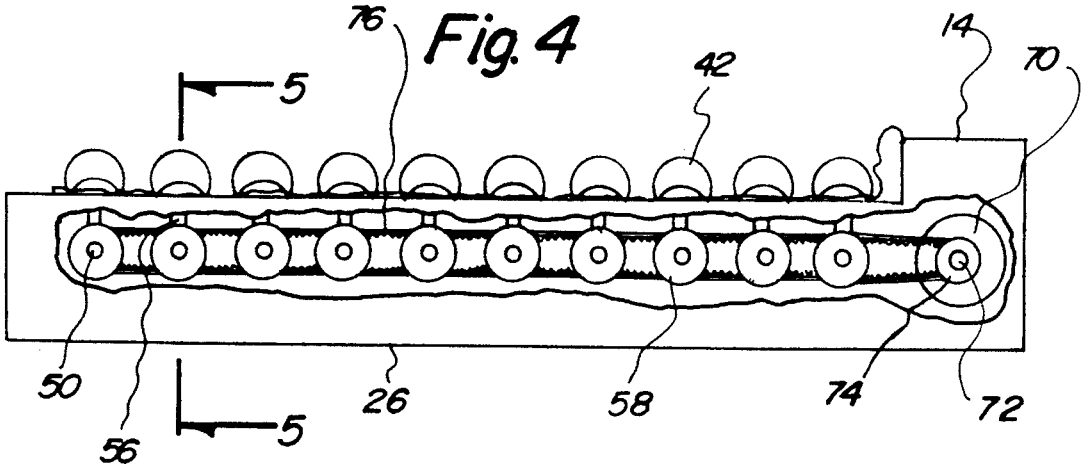
FIG. 4 is a cut away view of the present invention along line 4—4 of FIG. 3.
Figure 5:
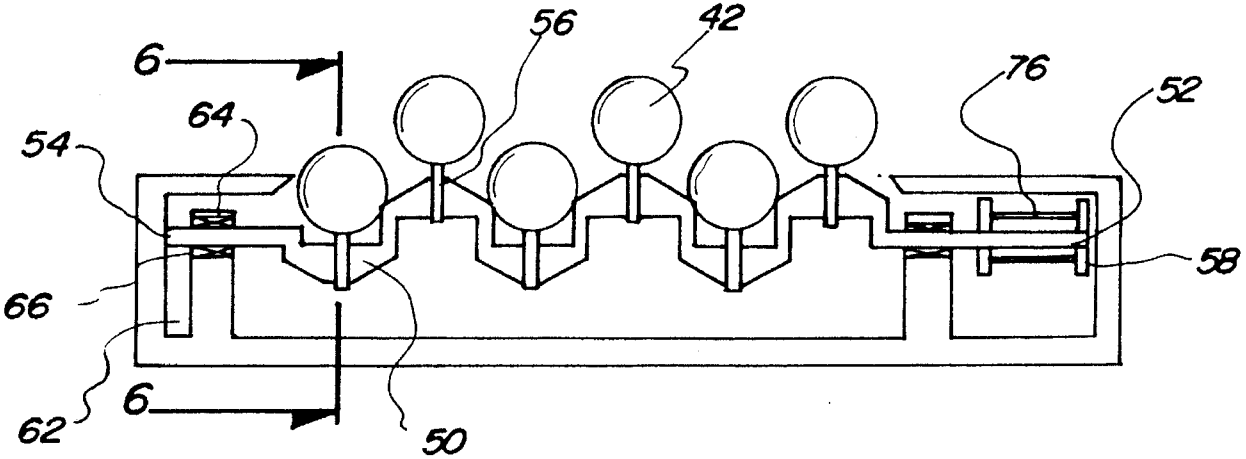
FIG. 5 is a cross-sectional view of the present invention along line 5—5 of FIG. 4.
Figure 6:
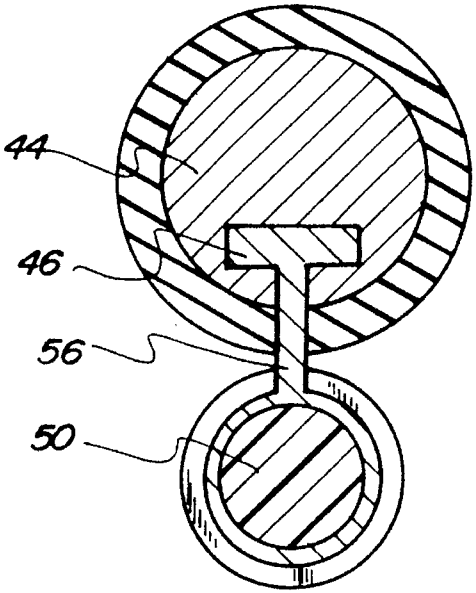
FIG. 6 is a cross-sectional view of the present invention along line 6—6 of FIG. 5.

Included is a plurality of rubber balls 42. Each rubber ball has a soft exterior and a rigid interior 44 with a crank pin 46 therein. FIGS. 4 and 5 depict the balls. FIG. 6 shows the rigid interior and the crank pin. Each rubber ball has a diameter that allows each ball to pass through a respective ball chamber 24 of the top 22 of the housing 12. The diameter of the ball is such that the motion of the ball is never impaired by the ball chamber.

As shown in FIG. 5 a plurality of crank shafts 50 are included. Each crank shaft has a coupling end 52, a rotation end 54 and a plurality of cranks 56 therebetween. Each crank shaft is positioned within the housing 12 and has one of each crank extending into each rubber ball. Each crank shaft is aligned in parallel linear planes within the housing. Each crank is in communication with the crank pin 46 of each ball. The crank being integral the crank pin. Each crank shaft, crank and crank are formed of metal or a metal alloy. The coupling end of each crank shaft has a pulley 58 coupled therearound. The crank shaft has a length of about 4 to 5 inches. The crank shaft is supported within the housing by a pair of rectangular projections 62. The projections allow the crank shafts to be positioned above the bottom of the housing.

Each projection is within the housing and extends upward from the bottom 26 and is spaced form the side wall of the housing 12. The projections are formed of the same rigid plastic use to make the housing. Each projection has an upper end 64 with a bearing 66 therein, as shown in FIG. 5. One of each bearing is capable of receiving the coupling end 52 prior to the coupling end having been positioned within the pulley 58. The other bearing receives the rotation end 54 of each crank shaft. The bearings of the projection allow the crank shaft to move within the housing.

FIG. 4, illustrates a cylindrical motor 70. The motor is positioned within the front portion 14 of the housing. The motor has a shaft rod 72 with a gear 74 extending therefrom. The gear is integral the shaft rod and has a tooth belt 76 positioned therearound. The tooth belt is rotated about the gear when the motor is operable. The tooth belt is formed of rubber.

Lastly, as illustrated in FIG. 4, the tooth belt has a length that allows it to extend around the pulley of each crank shaft. The length of the belt is about 75 percent of the length of the housing. The length percentage ensures that the belt remains tight around the gear and pulleys. The tooth belt is capable of applying an amount of tension when wrapped around the pulley 58 of the crank shaft to allow movement of the crank. The crank shaft 50 is moved along a center of rotation when the motor is activated. The motor is activated when a foot, positioned on the top of the housing, applies a force to the balls. The force applied by the foot causes the crank 56 to move the crank shaft and cause the belt around the gear to move for activation of the motor.

The present invention in a touch activated foot massage device that has rubber balls applying pressure against the foot. The rubber balls are rotated up and down by a crank and crank shaft. The crank shaft is rotated by a pulley that is connected in series with other pulleys that are connected to a gear. The gear is rotated by a motor. The device will improve health problems of the foot by the massage action of the balls.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved touch activated foot massage device comprising in combination:

a generally rectangular housing having a front portion, back end and side walls therebetween, the housing having a top with a plurality of ball chambers therethrough and a bottom, each ball chamber having a diameter of about ½ inch, the housing having an exterior width of about 5 to 6 inches, the back end and side walls having a height of about 4 inches, the front portion having a front height about 30 percent greater than the back end and side walls, the greater height providing space for a motor, the housing having a length being between about 14 to 15 inches;

a generally U-shaped cover formed of a flexible material having an upper portion with a pair of sleeves extending therefrom, the cover being positionable over the housing with the sleeves being in communication with the side walls of the housing, the cover having a decreasing height along the length of the housing with the height being 75 percent less at the front portion than at the back end of the housing, the back end of the housing allows a foot to easily be positioned on the device;

a plurality of rubber balls with each ball having a rigid interior with a crank pin therein, each rubber ball having a diameter for allowing each ball to pass through a respective ball chamber of the top of the housing;

a plurality of crank shafts with each crank shaft having a coupling end, a rotation end and a plurality of cranks therebetween, each crank shaft being positioned within the housing and each crank extending into a respective one of said rubber balls, each crank being in communication with the crank pin of each ball, the crank being integral with the crank pin, the coupling end of each crank shaft having a pulley coupled therearound, the crank shaft having a length of about 4 to 5 inches, each crank shaft being supported above the bottom of the housing and within the housing by a pair of rectangular projections;

each projection being within the housing and extending upward from the bottom and spaced from the side wall of the housing, each projection having an upper end with a bearing therein, one of the bearings of each said pair of projections being capable of receiving the coupling end prior to the coupling end being positioned within the pulley, the other of said bearings being capable of receiving the rotation end of each crank shaft;

a cylindrical motor being positioned within the front portion of the housing, the motor having a shaft rod with a gear extending therefrom, the gear being integral with the shaft rod and having a tooth belt positioned therearound, the tooth belt is rotated about the gear when the motor is operated; and the tooth belt having a length to extend around the pulley of each crank shaft, the length of the belt being about 75 percent of the length of the housing for ensuring tightness around the gear and pulleys, the tooth belt being capable of applying an amount of tension when wrapped around the pulley of the crank shaft for allowing movement of the crank, the crank shaft being moved along a center of rotation when the motor is activated, the motor being activated when a foot being positioned on the top of the housing applies a force to the balls thus causing the crank to move the crank shaft and cause the belt around the gear to move.

* * * * *